US007867340B2

(12) United States Patent
Pyo et al.

(10) Patent No.: US 7,867,340 B2
(45) Date of Patent: Jan. 11, 2011

(54) DISHWASHER AND SOUND-INSULATION MEMBER THEREFOR

(75) Inventors: Joon Ho Pyo, Seoul (KR); Tae Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 377 days.

(21) Appl. No.: 11/862,288

(22) Filed: Sep. 27, 2007

(65) Prior Publication Data

US 2008/0236637 A1 Oct. 2, 2008

(30) Foreign Application Priority Data

Mar. 26, 2007 (KR) ..... 10-2007-0029144

(51) Int. Cl.
*B08B 3/02* (2006.01)

(52) U.S. Cl. ..... 134/25.2; 134/200; 134/201

(58) Field of Classification Search ..... 134/200
See application file for complete search history.

(56) References Cited

U.S. PATENT DOCUMENTS

| | | | | |
|---|---|---|---|---|
| 3,703,792 | A * | 11/1972 | Bill | 52/242 |
| 5,744,213 | A * | 4/1998 | Nelson | 428/131 |
| 5,965,851 | A * | 10/1999 | Herreman et al. | 181/200 |
| 6,512,831 | B1 * | 1/2003 | Herreman et al. | 381/71.3 |
| 6,539,955 | B1 * | 4/2003 | Tilton et al. | 134/58 D |
| 7,334,589 | B2 * | 2/2008 | Jordan et al. | 134/200 |
| 7,409,959 | B2 * | 8/2008 | Retsema | 134/56 D |
| 2004/0206377 | A1 * | 10/2004 | Griffin et al. | 134/56 D |
| 2005/0028850 | A1 | 2/2005 | Nito et al. | 134/200 |
| 2005/0076938 | A1 | 4/2005 | Jordan et al. | 134/183 |
| 2006/0254854 | A1 * | 11/2006 | Herrera et al. | 181/200 |
| 2007/0272285 | A1 * | 11/2007 | Herreman et al. | 134/58 D |
| 2008/0128005 | A1 * | 6/2008 | Haeberle et al. | 134/115 R |

FOREIGN PATENT DOCUMENTS

| | | |
|---|---|---|
| DE | 31 50 655 | * 4/1983 |
| DE | 4013771 | 10/1991 |
| JP | 53-125462 | * 11/1978 |

OTHER PUBLICATIONS

International Search Report dated Oct. 29, 2007.
Written Opinion of the International Searching Authority dated Oct. 29, 2007.
Chinese Office Action for Application 2007/80052394 dated Sep. 13, 2010.

* cited by examiner

*Primary Examiner*—Frankie L Stinson
(74) *Attorney, Agent, or Firm*—KED & Associates, LLP

(57) ABSTRACT

A dishwasher is provided which can reduce the discharge of noise produced by the dishwasher, thereby preventing a user from being upset due to the noise and achieving not only a comfortable use environment but also an improvement in productivity. With the dishwasher, it is possible to prevent the noise, caused during operation of the dishwasher, from being discharged from a lower side of a door, by use of a sound-insulation member with a simplified configuration. In the manufacture of the dishwasher, improved assembly productivity can be accomplished.

23 Claims, 8 Drawing Sheets

DISHWASHER AND SOUND-INSULATION MEMBER THEREFOR

This application claims priority to Korean Patent Application No. 29144/2007, filed in Korea on Mar. 26, 2007, which is hereby incorporated by reference in its entirety.

BACKGROUND

1. Field

A dishwasher and a sound-insulation member therefor are disclosed herein.

2. Background

Generally, dishwashers are apparatus for washing dishes received therein by spraying wash water toward the dishes under high pressure, and drying the washed dishes. More specifically, in operation, wash water is sprayed, under high pressure, into a dishwashing tub or space in which the dishes are placed, to remove foreign matter, such as food residue, attached to the surfaces of the dishes.

Such dishwashers are usually configured such that the used wash water is recycled by filtering the food residue contained in the wash water using a filter, and a detergent is supplied and dissolved into the wash water to facilitate easy separation of the food residue from the dishes. Recently, there have been widely used dishwashers that employ additional devices for improving the washing efficiency of dishes, for example, a heater for raising the temperature of wash water, and a steam generator.

However, in the use of the dishwashers in the home or restaurant, there is the increasing problem that noise, caused during operation of the dishwasher, results in noise pollution and deterioration in the use environment. Most of the discharged noise is produced when wash water injected toward the dishes falls down within the tub, and vibration noise caused by devices, for example, a sump, in a lower machine room of the dishwasher.

The above described noises are mainly discharged through gaps between a front surface of a base located at a bottom of the dishwasher, and the lower end of a door and between the base and a dishwasher installation plane. In conclusion, the noises are discharged to the outside through spaces between the lower end of the door located at the front side of the dishwasher and the installation plane.

Although all of the above mentioned gaps may be sealed to block noises, such a sealing process complicates the overall manufacturing process and increases manufacturing costs. This results in a deterioration in the overall operation productivity of the dishwasher.

BRIEF DESCRIPTION OF THE DRAWINGS

Embodiments will be described in detail with reference to the following drawings in which like reference numerals refer to like elements, and wherein.

DETAILED DESCRIPTION

Figure 1:
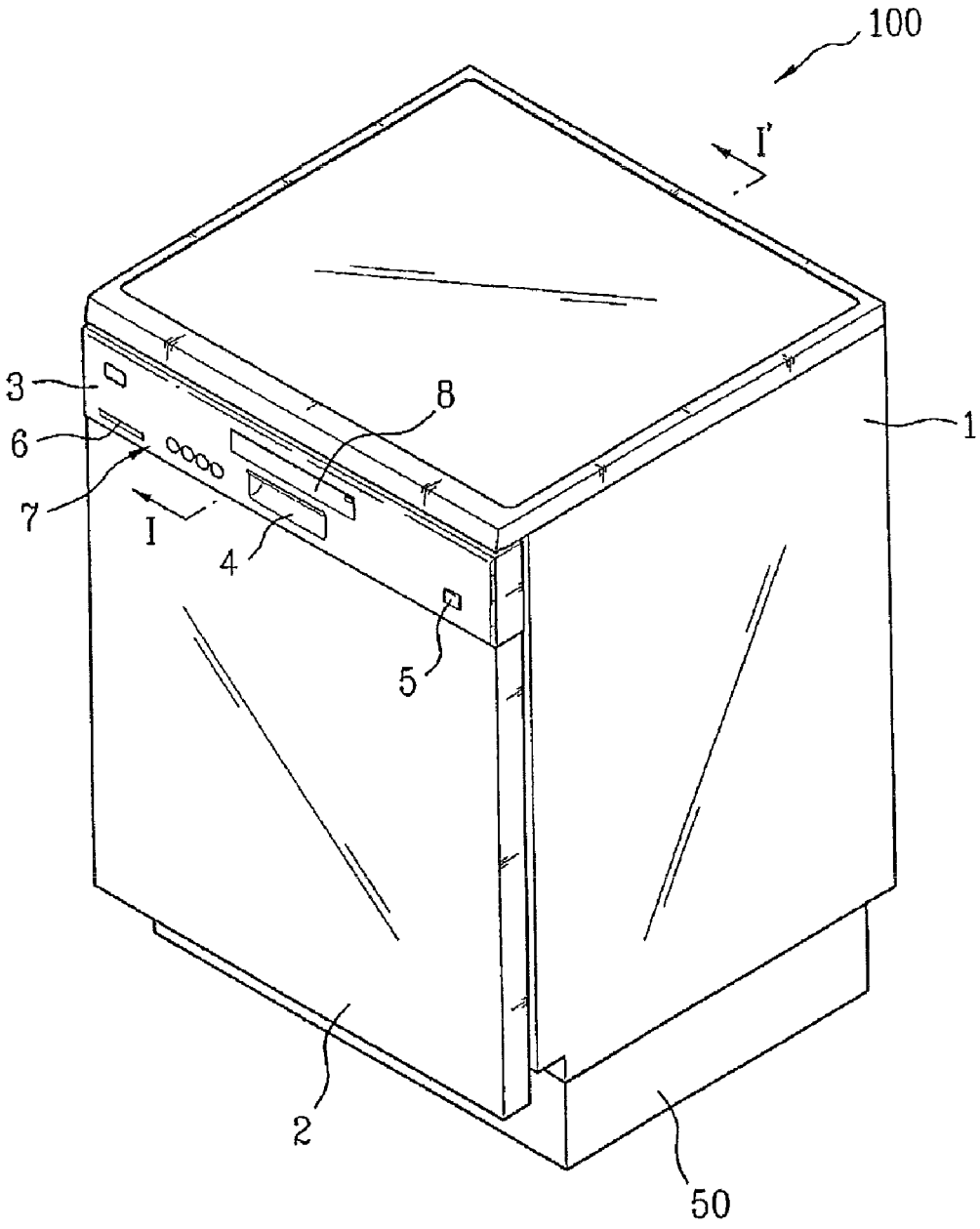
FIG. 1 is a front perspective view of a dishwasher in accordance with an embodiment.

Reference will now be made in detail to embodiments, examples of which are illustrated in the accompanying drawings. Wherever possible, like reference numerals have been used throughout the drawings to refer to the same or like parts.

Figure 2:
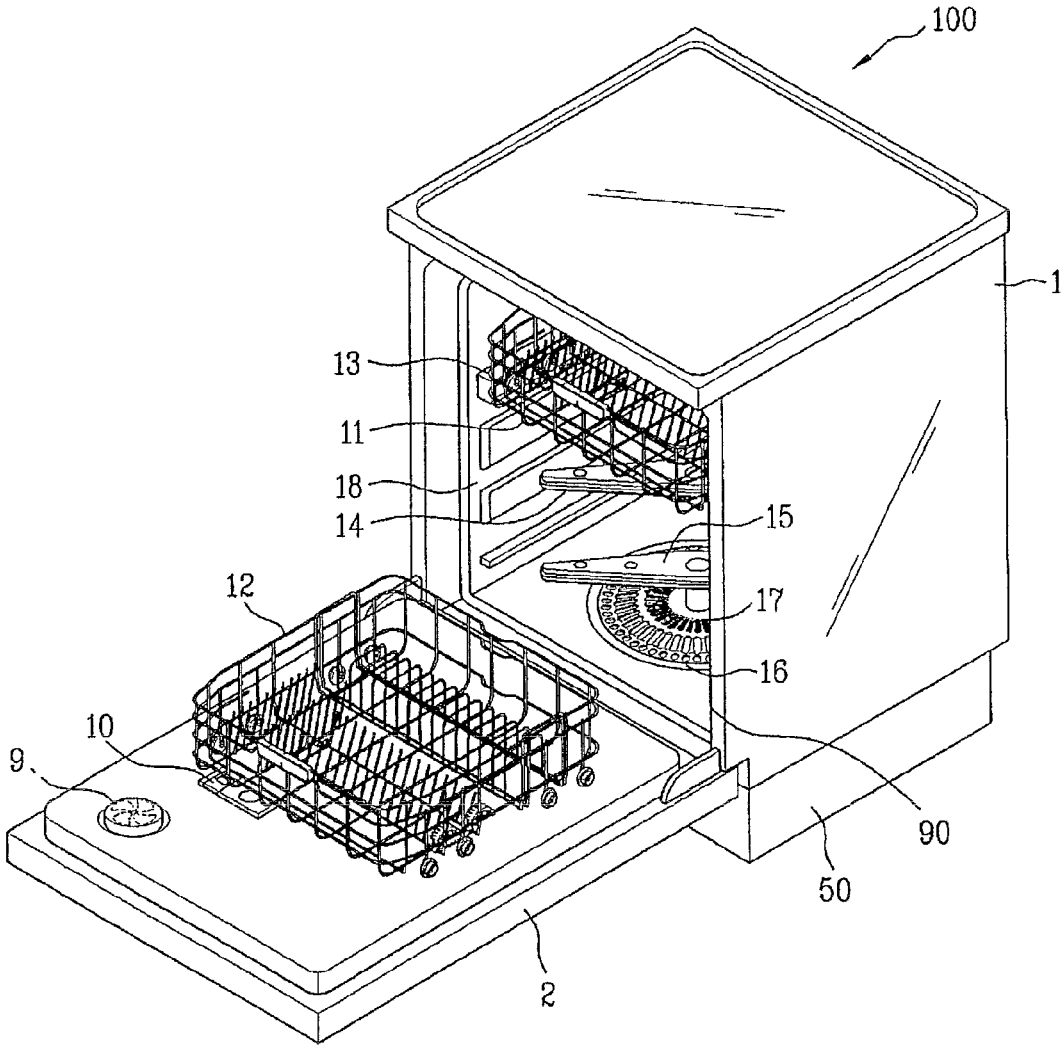
FIG. 2 is a front perspective view of the dishwasher of FIG. 1 in an opened door state.
Figure 3:
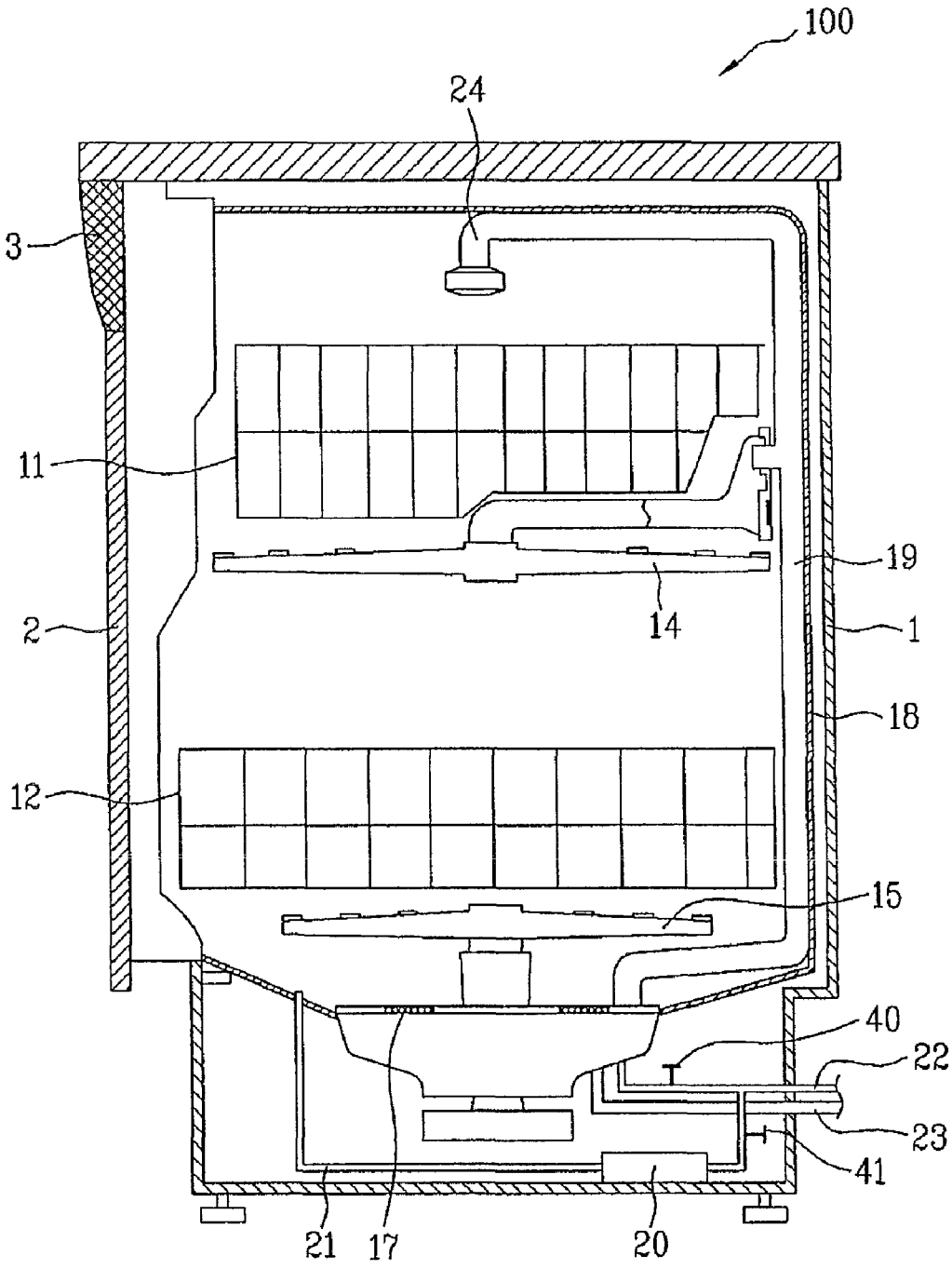
FIG. 3 is a sectional view taken along line I-I' of FIG. 1.
Figure 5:
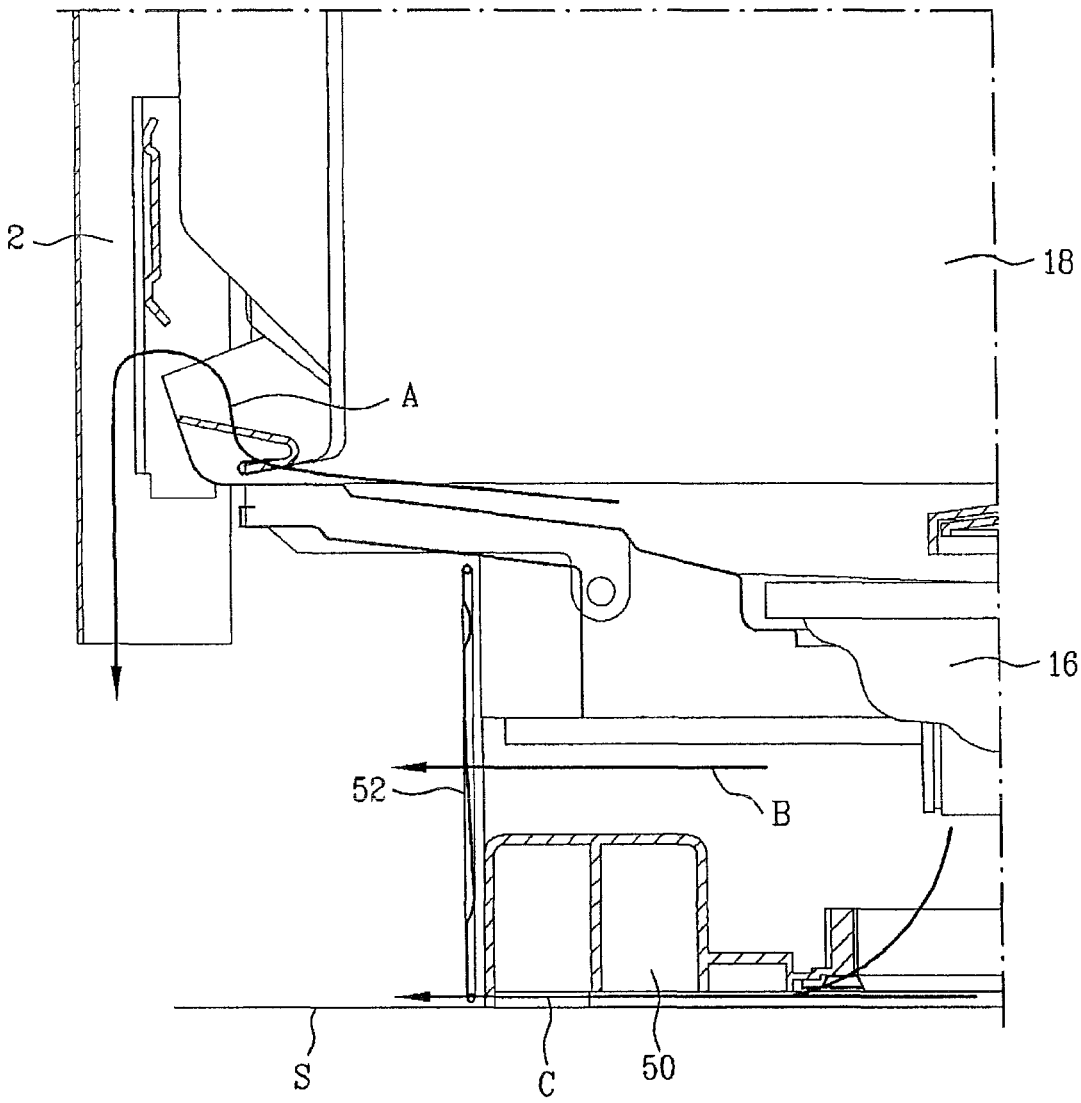
FIG. 5 is a partial sectional view illustrating noise discharge paths of the dishwasher of FIG. 1.
Figure 6:
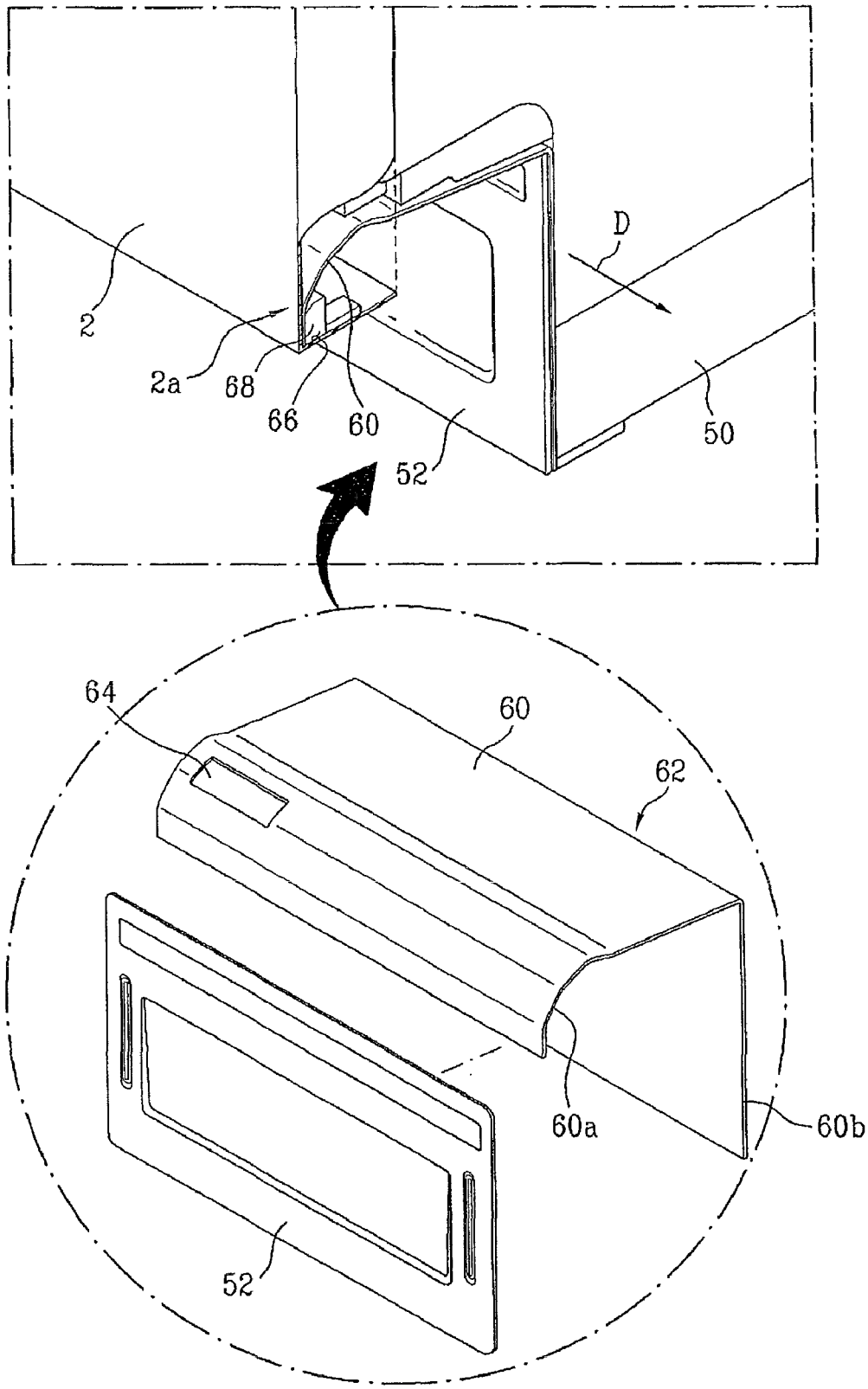
FIG. 6 is a partial perspective view illustrating a sound-insulation member of the dishwasher of FIG. 1.

Referring to FIGS. 1 to 3, the dishwasher 100 in accordance with an embodiment includes a case 1, a washing tub or space 18 disposed therein and having an opening 90, a door 2 provided to open or close the opening 90, a base 50 that supports the washing tub 18 such that the washing tub 18 is located at a predetermined height from a dishwasher installation plane S (see FIG. 5), and a sound-insulation member 60 (see FIG. 6). The sound-insulation member 60 may have an upper end 60*a* extended to a lower end of the door 2 and a lower end 60*b* extended to the installation plane S and may serve to prevent noise from leaking through spaces between the lower end of the door 2 and the installation plane S.

The washing tub 18 is disposed in the case 1, which defines an outer appearance of the dishwasher 100. Similar to the tub 18, the case 1 may have an opening at the same side as the washing tub 18. The washing tub 18 may be supported by the base 50 such that the washing tub 18 is located at a predetermined height from the installation plane S.

The washing tub 18 may include therein a plurality of racks 11 and 12, which are configured to be inserted into and withdrawn from the washing tub 18. Rails 13 for guiding movement of the racks 11 and 12 may be mounted at inner lateral surfaces of the washing tub 18 such that the rails 13 extend in front and rear directions. A plurality of nozzles 14, 15, and 24 may be installed to inject wash water toward the respective racks 11 and 12. A wash water channel 19 for supplying the wash water to upper ones of the nozzles 14 and 24 may be installed at one of the inner lateral surfaces of the washing tub 18. Also, a filter 17 may be mounted on a bottom surface of the washing tub 18, to filter impurities contained in used wash water.

The door 2, which may be provided to open or close the opening 90 of the washing tub 18, serves to close the front-side opening of the washing tub 18 when dishes received in the washing tub 18 are subjected to a washing cycle. The door 2 may have a lower end hingedly coupled to the case 1 such that the door 2 is pivotally rotatable about the lower end thereof. An exhaust fan 9 may be installed on the door 2 at a desired position. The exhaust fan 9 may be used to forcibly discharge air within the tub 18 to the outside. The door 2 may also have a detergent supply receptacle 10 formed in an inner surface thereof, to allow a predetermined amount of detergent to be mixed into the wash water during a washing cycle.

Meanwhile, a control panel 3 may be provided at an upper portion of the door 2. The control panel 3 may show an operating state of the dishwasher 100, and allow a user to control the overall functions of the dishwasher 100. More specifically, the control panel 3 may include, for example, a power switch to turn on or off the power of the dishwasher 100, a door grip 4 used when opening or closing the door 2, functional keys 7 to allow the user to input a desired operation of the dishwasher 100, a display window 8 to show the operating state of the dishwasher 100, and a steam outlet 6 to discharge high-temperature air produced within the dishwasher 100.

The base 50 may serve to support the tub 18 such that the tub 18 is located at a predetermined height from the installation plane 5. The base 50 may have an inner space therein. The inner space of the base 50 may be provided with a sump 16, which may be used to collect the wash water, having passed through the filter 17, for re-injection of filtered wash water into the washing tub 18.

The inner space of the base 50 may be further provided with a water supply pipe 22, a water drain pipe 23, a steam generator 20, and a steam supply channel 21. The water supply pipe 22 may be installed to connect the washing tub 18 to a water source located outside of the dishwasher, to supply wash water into the washing tub 18. The water drain pipe 23 may be used to discharge polluted or used wash water, which was used in the washing of dishes. The steam supply channel 21 may be used to guide steam, generated in the steam generator 20, into the washing tub 18.

The water supply pipe 22 may diverge into two water supply branch pipes directed to the washing tub 18 and the steam generator 20, respectively. To control an amount of water to be supplied through the respective diverged water supply branch pipes 22, a tub valve 40 and a steam generator valve 41 may be provided to open or close the respective water supply branch pipes 22. With this configuration, it is possible to control the amount of water to be supplied into the tub washing 18 by means of the tub valve 40 and to control the amount of water to be supplied into the steam generator 20 by means of the steam generator valve 41.

Hereinafter, the sound-insulation member 60 of the dishwasher in accordance with an embodiment will be described in detail.

Figure 4:
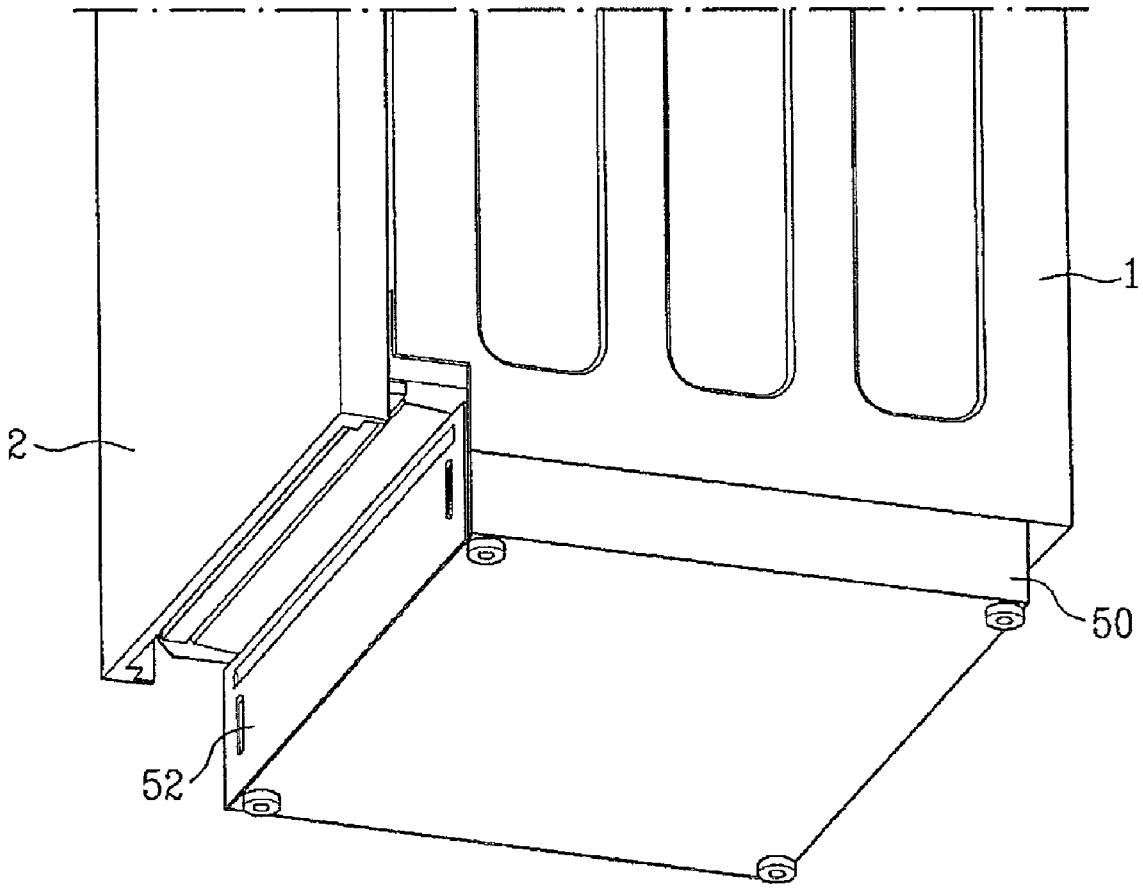
FIG. 4 is a partial perspective view viewed from the bottom of the dishwasher of FIG. 1.
Figure 7:
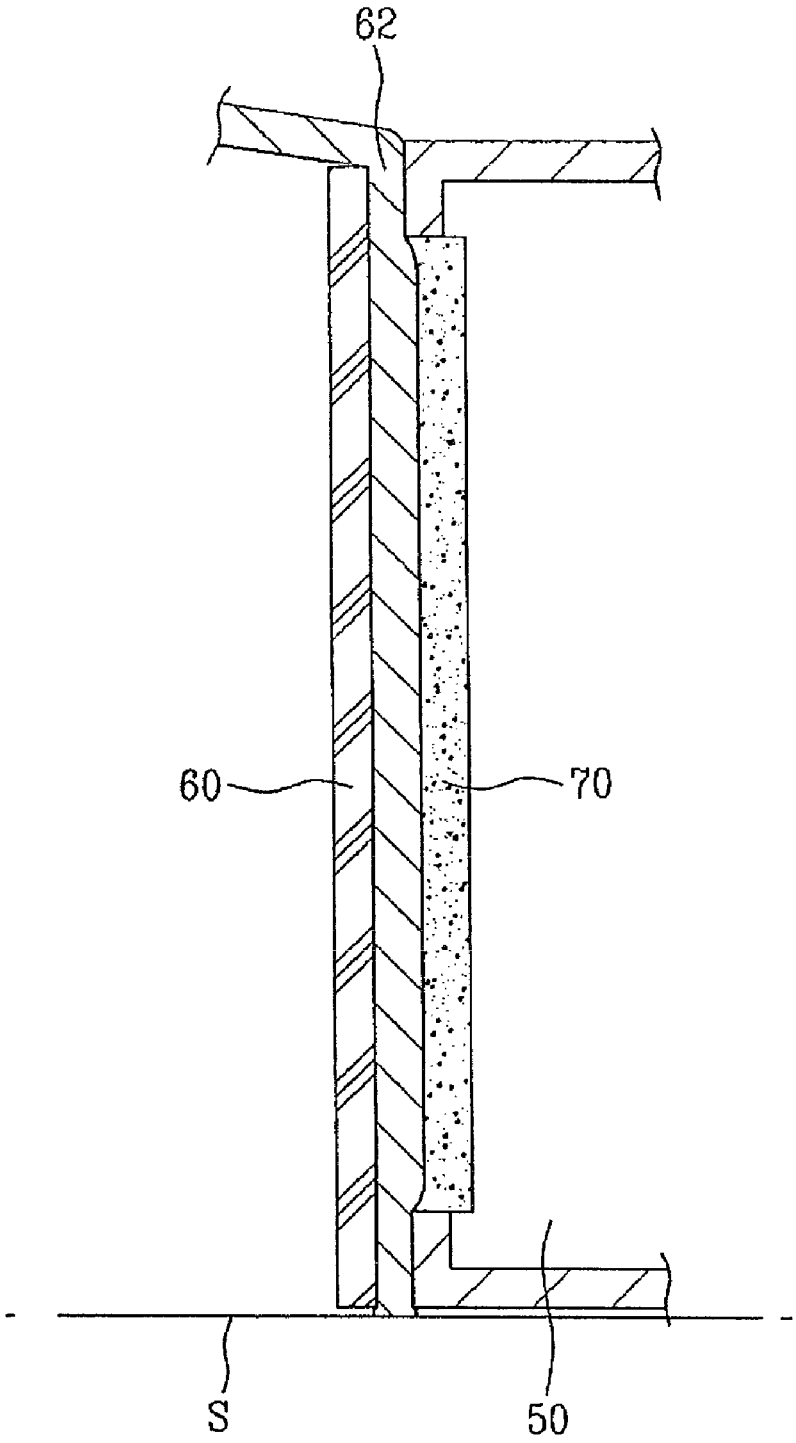
FIG. 7 is an enlarged sectional view of the sound-insulation member of FIG. 1.
Figure 8:
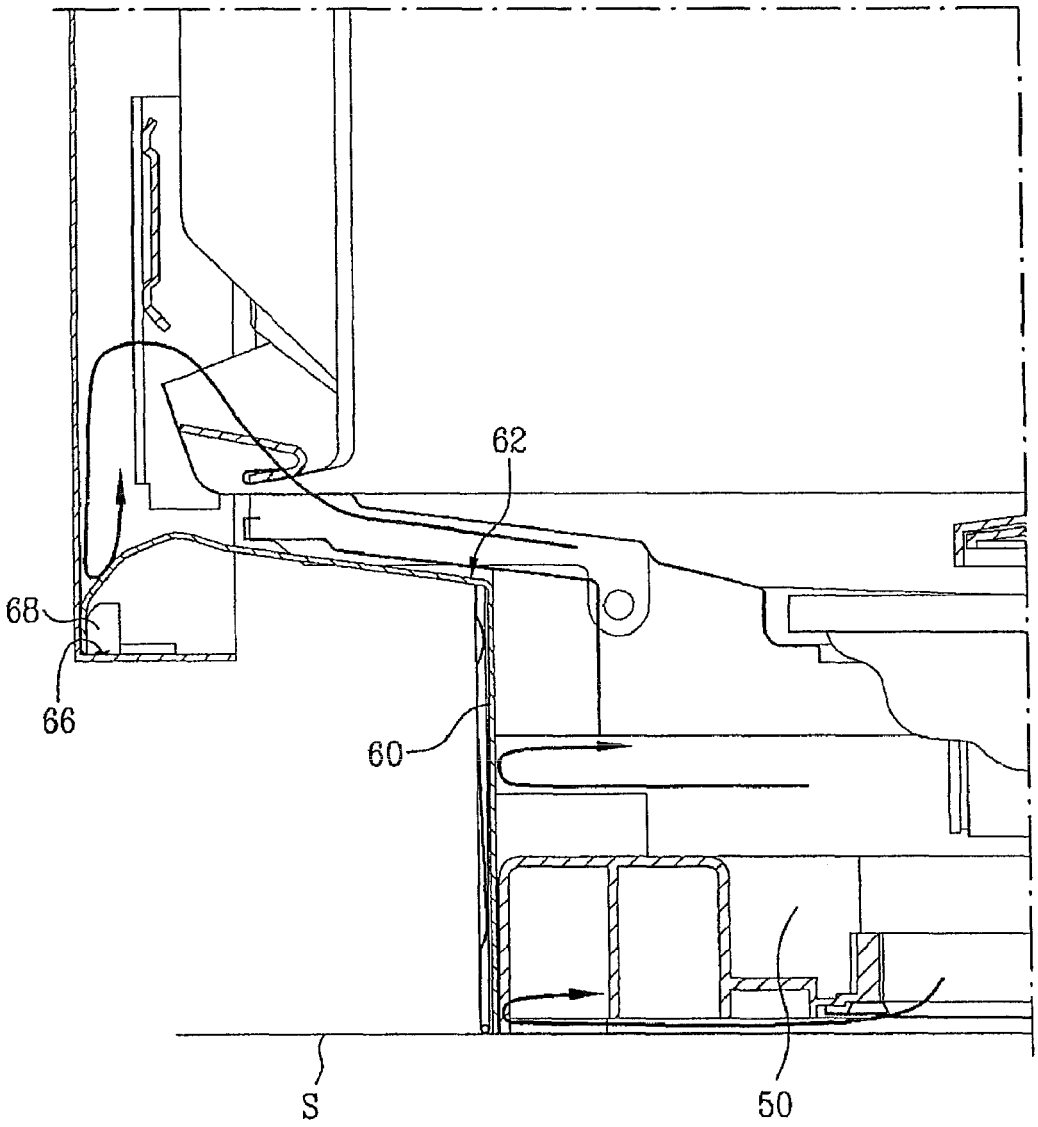
FIG. 8 is a partial sectional view illustrating a noise blocking operation of the sound-insulation member of the dishwasher of FIG. 1.

FIG. 4 is a partial perspective view viewed from the bottom of the dishwasher of FIG. 1. FIG. 5 is a partial sectional view illustrating noise discharge paths of the dishwasher. FIG. 6 is a partial perspective view illustrating the sound-insulation member of the dishwasher of FIG. 1. FIG. 7 is an enlarged sectional view of the sound-insulation member of FIG. 6. FIG. 8 is a partial sectional view illustrating a noise blocking operation of the sound-insulation member of the dishwasher of FIG. 1.

Referring to FIGS. 4 to 8, the sound-insulation member 60 according to an embodiment may be configured such that an upper end 60*a* thereof extends to the lower end of the door 2 and a lower end 60*b* thereof extends to the installation plane S, to prevent noise from leaking through spaces between the lower end of the door 2 and the installation plane S. Referring to FIG. 4, the base 50 is located at the bottom of the case 1. As described above, the base 50 may serve to support the washing tub 18 such that the washing tub 18 is located at a predetermined height from the installation plane S. The inner space of the base 50 may define a machine room in which a variety of elements, for example, the sump 16 and the steam generator 20, may be mounted.

The base 50 may be configured such that a front surface of the base 50 is located at a rearward position than the door 2, to define a certain space below the door 2. The space below the door 2 is generally called a "toe kick" space. The "toe kick" space may be sized to allow a user's feet to partially enter therein, to improve convenience for a user working in the kitchen.

A front cover 52 may be coupled to a front side of the base 50, to isolate the inner space of the base 50 from the outside. The front cover 52 may be coupled to the base 50 by means of fasteners, such as bolts or similar devices, or by a welding, a press method, or similar methods.

Meanwhile, as shown in FIG. 5, falling water noise is caused when wash water falls down within the washing tub 18, and also, vibration noise is caused when drive elements for example, the sump 16 and the steam generator 20, vibrate within the base 50. In addition, when water flows through the pipes, it causes flow noise. These noises are discharged outside of the dishwasher through spaces between the lower end of the door 2 and the installation plane S.

Considering the noise discharge paths in more detail, main noise discharge paths include a space defined between the base 50 and the lower end of the door 2, a front side of the base 50, and a space between the base 50 and the installation plane S. An additional noise discharge path is a space between the front cover 52 and base 40, in particular at side edges thereof. Thus, the noise discharge paths may include a path between a lower end of the door 2 and a front frame of the case 1 (see arrow A in FIG. 5), a path through a front side of the base 50 (see arrow B in FIG. 5), a path between the base 50 and the installation plane S (see arrow C in FIG. 5), and a path between the front cover 52 and the base 50 at side edges thereof (see arrow D in FIG. 6).

As shown in FIG. 6, the sound-insulation member 60 may be configured to block all of the above described noise discharge paths. That is, the upper end 60*a* of the sound-insulation member 60 may extend to the lower end of the door 2 and the lower end 60*b* of the sound-insulation member 60 may extend to the installation plane S, so as to prevent the above described noises from leaking through the spaces between the lower end of the door 2 and the installation plane S of the dishwasher 100. In this case, all of the above described noise discharge paths may be efficiently blocked by the sound-insulation member 60.

In an alternative embodiment, the sound-insulation member 60 may be fabricated by coupling two or more sound-insulation members. For example, a first member, which extends from an upper end of the base 50 to the installation plane S so as to cover the front side of the base 50 and the space between the base 50 and the installation plane S, and a second member, which extends from the upper end of the base 50 to the lower end of the door 2 so as to cover the space between the lower end of the door 2 and the base 50, may be coupled to each other, to form the sound-insulation member 60.

However, in the embodiment of FIG. 6, the sound-insulation member 60 takes the form of an integrally-formed single member capable of simultaneously blocking all of the above described noise discharge paths. In this case, the sound-insulation member 60 may be formed with a bent portion 62, to maintain the "toe kick" space below the door 2. More specifically, the bent portion 62 may be formed at a portion of the sound-insulation member 60 corresponding to the front upper end of the base 50. That is, the bent portion 62 of may be configured such that one end of the sound-insulation member 60 extends horizontally to the lower end of the door 2 and the other end of the sound-insulation member 60 extends vertically to the installation plane S. At the distal end, the sound-insulation member 60, extended to the installation plane S, comes into contact with the installation plane S, so as to block the noise discharge path corresponding to the space between the base 50 and the installation plane S.

The sound-insulation member 60 may be positioned such that a portion of the sound-insulation member 60 may be inserted behind the front cover 52 that is, between the front cover 52 and the base 50. In this case, the sound-insulation member 60 blocks the front side of the base 50. Specifically, after a portion of the sound-insulation member, extended downward from the bent portion 62, is located at the front side of the base 50, the front cover 52 may be coupled to the base 50 from the front side of the base 50. Further, the sound-insulation member 60 may be secured in a state in which it is inserted between the base 50 and the front cover 52. The sound-insulation member 60 may be coupled to the base 50 by means of fasteners, such as bolts or similar devices, or by welding, a press method, or similar methods, so that the sound-insulation member 60 is secured between the front cover 52 and the base 50.

When the sound-insulation member 60 is coupled to the base 50 together with the front cover 52, there may be no need for a separate operation for coupling or securing the sound-insulation member 60, and therefore, the sound-insulation member 60 in accordance with embodiments has the advantage of improved assembly productivity in the manufacture of the dishwasher. In particular, as described above, when the sound-insulation member 60 is an integrally-formed single member, the overall manufacturing process and the assembly operation of the dishwasher may be further simplified.

Further, one end of the sound-insulation member 60 may be connected to an inner lower end portion of the door 2. More specifically, a portion of the sound-insulation member 60 corresponding to the front side of the base 50 may be coupled to the base 50 together with the front cover 52, and a portion of the sound-insulation member 60 may be extended to the lower end of the door 2 to be connected and secured to the inner lower end portion 2*a* of the door 2.

The door 2 may have a fixing recess 66 formed at the inner lower end portion 2*a* thereof, into which the end 60*a* of the sound-insulation member 60 may be inserted. Moreover, a press member 68 may be provided such that the press member 68 is inserted into the fixing recess 66 together with the end 60*a* of the sound-insulation member 60, to secure the sound-insulation member 60 to the door 2. More specifically, as the press member 68 is pushed into the fixing recess 66 together with the end 60*a* of the sound-insulation member 60 that was previously inserted into the fixing recess 66, the 60*a* end of the sound-insulation member 60 is connected and secured to the inner lower end portion 2*a* of the door 2. Consequently, by connecting the end 60*a* of the sound-insulation member 60 to the inner lower end portion 2*a* of the door 2 by means of the above described simple configuration, it may be possible to prevent the discharge of noise through the space between the lower end of the door 2 and the base 50, and to achieve a further improved installation operation efficiency of the sound-insulation member 60.

A distal end region of the sound-insulation member 60 facing the door 2 may be formed with a hole 64, as shown in FIG. 6. The hole 64 allows for the passage of the air circulated in the door 2 under operation of the exhaust fan 9.

Referring to FIG. 7, the sound-insulation member 60 of the dishwasher 100 in accordance with an embodiment can serve as a packing between the base 50 and the front cover 52 to block the discharge of noises. More specifically, the sound-insulation member 60 may be interposed between the base 50 and the front cover 52 of the base 50 and may be pressed when the front cover 52 is coupled to the base 50, thereby serving to block the discharge of noise through a gap between the base 50 and the front cover 52. In addition to the above described role of a packing, the sound-insulation member 60 may serve not only to block an entrance of the machine room defined in the base 50, but also to block the discharge of noise through spaces between the lower end of the door 2 and the base 50 and between the base 50 and the installation plane S.

The sound-insulation member 60 may be made of a flexible material, such as rubber, soft synthetic resin, or similar materials. When the sound-insulation member 60 is made of a flexible material, the sound-insulation member 60 may be efficiently pressed between the base 50 and the front cover 52 so as not to leave a gap, resulting in a more successful implementation of the role of a packing.

With the sound-insulation member 60 according to embodiments, since a portion of the sound-insulation member 60 in contact with the installation plane S is pressed by the weight of the dishwasher 100, the sound-insulation member 60 may efficiently prevent the discharge of noise through the space between the base 50 and the installation plane S. Also, since one end 60*a* of the sound-insulation member 60 may be connected to the inner lower end position 2*a* of the door 2, when the door 2 is pivotally rotated about the lower end thereof to open or close the washing tub 18, the sound-insulation member 60, which may be made of a flexible material, may ensure a smooth pivotal rotation of the door 2, and furthermore, can be free from damage from the pivotal rotation of the door 2.

The sound-insulation member 60 may be formed by double injection molding. For example, a portion of the sound-insulation member 60 may be made of a hard material and the remaining portion of the sound-insulation member 60 may be made of a soft material. That is, a portion of the sound-insulation member 60, which may be inserted between the base 50 and the front cover 52 to perform the role of a packing, and another portion of the sound-insulation member 60, which may be connected to the inner lower end portion 2*a* of the door 2, may be made of a soft material, and the remaining portion of the sound-insulation member 60 around the bent portion 62 may be made of a hard material.

Additionally, the sound-insulation member 60 may be provided with a sound-absorbing member 70, to efficiently block the discharge of noises through the front side of the base 50. More specifically, the sound-absorbing member 70 may be coupled to a portion of the sound-insulation member 60 to be inserted between the base 50 and the front cover 52, to absorb noise transmitted to the front side of the base 50 and achieve a further improvement in the noise blocking efficiency. The sound-absorbing member 70 may be made of, for example, a porous sound-absorbing member or other sound-absorbing boards, such as a veneer board, a gypsum board, a fibrous board, an asbestos board, or similar material.

Hereinafter, the operation of the dishwasher in accordance with embodiments disclosed herein will be described.

First, when it is intended to wash dishes, the door 2 is opened and dishes are arranged on the racks 11 and 12. The racks 11 and 12 are then inserted into the dishwasher 100 at correct positions, and the door 2 is closed.

Next, the functional keys 7 are operated by the user, and the dishwasher 100 begins a desired washing operation selected by the user. While the selected operation of the dishwasher 100 is performed, an operating state of the dishwasher 100 is displayed on the display window 8.

Explaining the operation of the dishwasher 100 on the basis of the flow course of wash water within the washing tub 18, the wash water is supplied through the water supply pipe 22, and then, is injected from the nozzles 14, 15, and 24, to wash the dishes arranged on the racks 11 and 12. The wash water, used to wash the dishes, falls down and is collected in the sump 16. The sump 16 includes a pump (not shown) having an impeller (not shown), to supply the wash water into the nozzles 14, 15, and 24. In this way, the wash water is circulated from the sump 16 to the nozzles 14, 15, and 24. If necessary, steam, generated in the steam generator 20, is supplied into the washing tub 18 through the steam supply channel 21.

While the above described operation of the dishwasher 100 is in progress, the dishwasher 100 causes various noise, for example, a falling water noise caused when the wash water falls down within the washing tub 18, a vibration noise caused by vibrations of the drive elements, for example, the sump 16 and the steam generator 20, disposed in the base 50, and a flow noise caused when the wash water flows through the various pipes. These noises are transmitted outside of the dishwasher through the spaces between the lower end of the door 2 and the installation plane S. More specifically, the space between the base 50 and the lower end of the door 2, the front side of the base 50, the space between the base 50 and the installation place S, and the space between the front cover 52 and base 50, in particular at side edge thereof.

However, according to embodiments, by applying the sound-insulation member 60 to the dishwasher 100 as shown in FIG. 8, it is possible to simultaneously block the discharge of noise through the space between the base 50 and the lower end of the door 2, through the front side of the base 50, through the space between the base 50 and the installation plane S, and through the space between the front cover 52 and base 50 at side edge thereof, by use of the single sound-insulation member 60.

Further, since the sound-insulation member 60 is interposed between the base 50 and the front cover 52 of the base 50 so as to perform the role of a packing, the sound-insulation member 60 may also prevent the discharge of noise through the gap between the base 50 and the front cover 52.

In the manufacturing process of the dishwasher, since the sound-insulation member 60, which may take the form of an integrally formed single member, is coupled to the base 50 together with the front cover 62, the manufacturing process may be simplified and the assembling productivity of the dishwasher improved.

A dishwasher according to embodiments disclosed herein is capable of reducing the discharge of noise caused within a system to the maximum extent, thereby preventing a user from being upset due to the noises and achieving not only a comfortable use environment but also an improvement in productivity.

A dishwasher according to an embodiment disclosed herein is provided that includes a tub having a space therein and formed, at a side thereof, with an opening, a door provided to open or close the opening, a base that supports the tub such that the tub is located at a predetermined height from a machine installation plane, and a single sound-insulation member having an upper end extended to a lower end of the door and a lower end extended to the installation plane, that prevents noise from leaking through spaces between the lower end of the door and the installation plane. The base may have a front surface located at a rearward position than the door, that defines a desired space below the door, and the sound-insulation member may have a bent portion corresponding to the space.

The sound-insulation member may be inserted behind a front cover of the base, so as to block a front side of the base. The sound-insulation member may be connected to an inner lower end position of the door. In such as case, a fixing recess may be formed in the inner lower end position of the door such that a distal end of the sound-insulation member may be inserted into the fixing recess, and a press member may be provided in the fixing recess. The press member may be configured to be inserted into the fixing recess together with the distal end of the sound-insulation member, to secure the sound-insulation member to the door.

The sound-insulation member may be made of a flexible material. Further, the sound-insulating member may be formed by double injection molding such that a portion of the sound-insulation member is made of a hard material and the remaining portion of the sound-insulation member is made of a soft material.

A dishwasher according to an embodiment disclosed herein is provided that includes a tub having a space therein and formed, at a side thereof, with an opening, a door provided to open or close the opening, a base that supports the tub such that the tub is located at a predetermined height from a machine installation plane, and a sound-insulation member mounted to the base to simultaneously block the discharge of noise through a space between the base and a lower end of the door, a front side of the base, and a space between the base and the installation plane.

A dishwasher according to an embodiment disclosed herein is provided that includes a tub having a space therein and formed, at a side thereof, with an opening, a door provided to open or close the opening, a base that supports the tub such that the tub is located at a predetermined height from a machine installation plane, and a packing interposed between the base and a front cover of the base that blocks the discharge of noise through a gap between the base and the front cover. The packing may be installed to block an entrance of a machine room defined in the base. An upper end of the packing may extend to the lower end of the door, to block the discharge of noise through a space between the lower end of the door and the base. A lower end of the packing may extend to the installation plane, to block the discharge of noise through a space between the base and the installation plane.

A dishwasher in accordance with the embodiments disclosed herein has at least the following advantages.

First, the dishwasher according to embodiments disclosed herein is capable of blocking noise caused during operation of the dishwasher, from leaking from the lower side of a door.

Second, as a result of applying a single sound-insulation member to the dishwasher with a simplified configuration, improved assembly productivity can be achieved in the manufacture of the dishwasher.

Third, a dishwasher according to embodiments disclosed herein is capable of reducing the discharge of noise caused within a system to the maximum extent, thereby preventing a user from being upset due to the noise and achieving a comfortable use environment.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a case having a dishwashing space disposed therein;

a door openably attached to the case;

a base on which the case is supported;

a front cover mounted on a front side of the base; and a single sound-insulation member that substantially prevents noise discharge between a lower end of the door and a front frame of the case, through the front cover of the base, and between the base and the floor, wherein the single sound-insulation member comprises a vertically extending portion, a horizontally extending portion that extends from vertically extending portion, and a curved front portion that extends from the horizontally extending portion.

2. The dishwasher of claim 1, wherein the single sound-insulation member comprises a flexible material.

3. The dishwasher of claim 1, wherein the single sound-insulation member further substantially prevents sound from leaking out from spaces formed between side edges of the front cover and the base.

4. The dishwasher of claim 1 further comprising a sound absorbing member mounted on the vertically-extending portion.

5. The dishwasher of claim 1, wherein the single sound-insulation member is positioned between the front cover and the base.

6. The dishwasher of claim 1, further comprising a sound absorbing member provided between the single sound-insulation member and the base.

7. The dishwasher of claim 6 wherein the sound-absorbing member is made of a porous sound-absorbing material.

8. The dishwasher of claim 1, further comprising a sound absorbing member attached to the single sound-insulating member.

9. The dishwasher of claim 8, wherein the sound-absorbing member is made of a porous sound-absorbing material.

10. The dishwasher of claim 1, wherein a lower end of the door is positioned from the base by a predetermined space and the single sound-insulation member extends along a length of the space and along a vertical length of the base to the floor.

11. The dishwasher of claim 1, wherein the single sound-insulation member is coupled to the base by one of fasteners, welding, or press-fitting.

12. The dishwasher of claim 1, wherein the door includes a fixing recess for receiving a distal end of the single sound-insulation member and a press member that secures the distal end in the fixing recess.

13. The dishwasher of claim 1, wherein the single sound-insulation member includes an air hole.

14. The dishwasher of claim 1, wherein the single sound-insulation member is formed by double injection molding such that a portion is made of a hard material and a portion is made of a soft material.

15. A method of reducing discharge of noise from a dishwasher, the dishwasher comprising a case having a dishwashing space disposed therein, a door openably attached to the case, a base on which the case is supported, and a front cover mounted on a front side of the base, the method comprising:

providing a single sound-insulation member; and extending the single sound-insulation member from a lower end of the door along a horizontal length between the lower end of the door and the front cover of the base and along a vertical length of the base so as to substantially prevent noise discharge between a lower end of the door and a front frame of the case, through a front side of the base, and between the front cover of the base and a floor, wherein the single sound-insulation member comprises a vertically extending portion, a horizontally extending portion that extends from vertically extending portion, and a curved front portion that extends from the horizontally extending portion.

16. The method of claim 15, wherein the single sound-insulation member comprises a flexible material.

17. The method of claim 15, further comprising positioning the single sound-insulation member between the front cover of the base and the base.

18. The method of claim 15, further comprising providing a sound absorbing member attached to the single sound-insulating member.

19. The method of claim 15, further comprising attaching the single sound-insulation member to the base by one of fasteners, welding, or press-fitting.

20. The method of claim 15, further comprising providing the single sound-insulation member with an air hole.

21. The method of claim 15, further comprising forming the single sound-insulation member by double injection molding such that a portion is made of a hard material and a portion is made of a soft material.

22. A dishwasher, comprising:

a case having a dishwashing space disposed therein;

a door openably attached to the case;

a base on which the case is supported;

a front cover mounted on a front side of the base; and a single sound-insulation member that substantially prevents noise discharge between a lower end of the door and a front frame of the case, through a front side of the base, and from spaces formed between side edges of the front cover and the base wherein the single sound-insulation member comprises a vertically extending portion, a horizontally extending portion that extends from vertically extending portion, and a curved front portion that extends from the horizontally extending portion.

23. A dishwasher, comprising:

a case having a dishwashing space disposed therein;

a door openably attached to the case;

a base on which the case is supported;

a front cover mounted on a front side of the base; and a single sound-insulation member that substantially prevents noise discharge through a front side of the front cover of the base, between the front cover of the base and the floor, and from spaces formed between side edges of a front cover and the front cover of the base, wherein the single sound-insulation member comprises a vertically extending portion, a horizontally extending portion that extends from vertically extending portion, and a curved front portion that extends from the horizontally extending portion.

* * * * *